United States Patent [19]

Doner et al.

[11] Patent Number: 4,828,732

[45] Date of Patent: May 9, 1989

[54] GREASE COMPOSITIONS COMPRISING BORATED DIOLS AND HYDROXY-CONTAINING THICKENERS

[75] Inventors: John P. Doner, Sewell; Andrew G. Horodysky, Cherry Hill; John A. Keller, Jr., Pitman, all of N.J.

[73] Assignee: Mobil Oil Corporation, New York, N.Y.

[21] Appl. No.: 185,619

[22] Filed: Apr. 25, 1988

Related U.S. Application Data

[63] Continuation-in-part of Ser. No. 54,104, May 20, 1987, abandoned, Continuation of Ser. No. 894,072, Aug. 11, 1986, abandoned, Continuation of Ser. No. 792,168, Oct. 25, 1985, abandoned, Continuation of Ser. No. 643,347, Aug. 22, 1984, abandoned.

[51] Int. Cl.[4] ..... C10M 137/10

[52] U.S. Cl. ..... 252/32.7 E; 252/49.6

[58] Field of Search ..... 252/49.6, 32.7 E

[56] References Cited

U.S. PATENT DOCUMENTS 4,743,386 5/1988 Doner et al. ..... 252/49.6

4,759,873 7/1988 Audeh ..... 252/49.6

*Primary Examiner*—Jacqueline V. Howard

*Attorney, Agent, or Firm*—Alexander J. McKillop; Charles J. Speciale; Van D. Harrison, Jr.

[57] ABSTRACT

Grease compositions, wherein the grease is thickened with a metal hydroxy-containing soap grease thickener are provided. Another essential ingredient of the composition is a borated hydrocarbyl diol. The compositions may also contain phosphorus and sulfur moieties.

27 Claims, No Drawings

GREASE COMPOSITIONS COMPRISING BORATED DIOLS AND HYDROXY-CONTAINING THICKENERS

This is a continuation-in-part of copending application Ser. No. 054,104, filed on May 20, 1987, which is a continuation of application Ser. No. 894,072, filed Aug. 11, 1986, which is a continuation of application Ser. No. 792,168, filed Oct. 25, 1985, which is a continuation of application Ser. No. 643,347, filed on Aug. 22, 1984 all now abandoned.

BACKGROUND OF THE INVENTION

1. Field of the Invention

The invention is concerned with a novel group of compositions. It more particularly relates to a synergistic grease composition comprising oil, hydroxy-containing soap thickener and borated hydrocarbyl diol, and optionally phosphorus and sulfur moiteis.

2. Discussion of the Prior Art

Borated diols have been used in commercial lubricant formulations to provide improvement in lubricity properties. They have also, on occasion, been used in brake fluid formulations.

The grease compositions containing one or more of hydroxy-containing soaps, one or more of the disclosed borated diols and one or more of the sulfur- and phosphorus-containing compositions described herein provided advantages in increased dropping point, improved grease consistency properties, antitrust characteristics and potential antifatigue, antiwear and antioxidant benefits unavailable in any prior grease. In addition, unlike any of such prior art greases, the high dropping point extended temperature range metallic soap greases of this invention are preferably manufactured by mixing additive quantities of the diol borates to the fully formed soap grease afer completion of saponification.

The high temperature grease compositions described herein are believed to be novel. To the best of our knowledge, the unique grease compositions using borated diols and the process of manufacturing the disclosed high temperature multifunctional greases have not been previously reported or used.

SUMMARY OF THE INVENTION

In accordance with the invention, there is provided an improved grease composition containing a major proportion of a grease and a borated diol composition consisting essentially of the reaction product prepared by reacting a diol, preferably vicinal, of the formula $$R(OH)_2$$

wherein R is a $C_8$ to $C_{30}$ hydrocarbyl group with a boron compound which may be boric acid, boric oxide, metaborate or an alkyl borate of the formula $$(R^1O)_yB(OH)_z$$

wherein y is 1 to 3, z is 0 to 2, their sum being 3, and $R^1$ is an alkyl group containing from 1 to 6 carbon atoms, the improvement comprising thickening said grease with a thickener containing a hydroxy-containing soap thickener. The presence of phosphorous and sulfur moieties provides an even higher drop point.

Preferably the diol is overborated. By "overborated" is meant the presence in the borated product of more than a stoichiometric amount of boron.

DESCRIPTION OF SPECIFIC EMBODIMETNS

The borated compound used in this invention can be made using a single diol or two or more diols. A mixture of diols can contain from about 5% to about 95% by weight of any one diol, the other diol or diols being selected such that it or they together comprise from about 95% to about 5% by weight of the mixture. Such mixtures are often preferred to the single diol.

The hydrocarbyl vicinal diols contemplated for use in this invention can be linear, branched or cyclic, saturated or unsaturated, with linear saturated members often being preferred to maximize friction reduction. The two hydroxyl groups can be anywhere along the hydrocarbyl chain, and they are preferably on adjacent carbon atoms (vicinal), but the terminal diols are much preferred.

The preferred vicinal diols can be synthesized using several methods known to the art, such as the method described in *J. Am. Chem. Soc.*, 68, 1504 (1946), which involves the hydroxylation of 1-olefins with peracis. Vicinal dolls can be prepared by the peroxytrifluoroacetic acid method for the hydroxylation of olefins as described in *J. Am. Chem. Soc.*, 76, 3472 (1954). Similar procedures can be found in U.S. Pat. Nos. 2,411,862, 2,457,329 and 2,455,892 or they can also be prepared via catalytic epoxidation of an appropriate olefin followed by hydrolysis to form the appropriate vicinal diol.

The preferred borated vicinal diols contain 12 to 20 carbon atoms. Below a carbon number of 12 friction-reducing properties begin to diminish. Preferred are the $C_{14}$–$C_{18}$ hydrocarbyl groups in which soubility, frictional characteristics and other properties are maximized.

Among the diols contemplated for reaction with the boron compound are 1,2-octanediol, 1,2-decanediol, 1,2-dodecanediol, 1,2-tetradecanediol, 1,2-pentadecanediol, 1,2-octanedecanediol, 1,2-eicosanediol, 1,2-triacontanediol, 1,2-mixed $C_{15}$ to $C_{18}$- alknediols, as well as diols derived from epoxide derivatives of propylene oligomers such as the trimer or tetramer or from butylene oligomers such as the trimers, and mixtures of any of these.

Reaction of the diol with the boron compound as set forth hereinabove can be preformed at reaction temperatures of 90° C. to 260° C. or more can be used, but 110° to 200° C. is preferred. Up to a stoichiometric amount of boric acid or other boron compound can be used, or an excess thereof can be used to produce a derivative containing from about 0.1% to about 10% of the boron. At least 5% to 10% of the available hydroxy groups of the diol should be borated to derive substantial beneficial effect. The alkyl borates that can be used include mono-di- or trialkyl borate, such as mono-, di- or trimethyl, triethyl, tripropyl, tributyl, triamyl or trihexyl borate, often in the presence of boric acid. Times for boration using any of the contemplated boron compounds can be from about 2 to about 12 hours or more.

While atmospheric pressure is generally preferred when using any borating agent contemplated, the reaction can be advantageously run at from about 1 to about 5 atmospheres. Furthermore, where boration conditions warrant it, a solvent may be used. In general, any relatively non-polar, unreactive solvent can be used, including benzene, toluene, xylene and 1,4-dioxane. Other hydrocarbon and alcoholic solvents, which include propanol, butanol and the like, can be used. Mixtures of alcoholic and hydrocarbon solvents can be used also.

A narrow class of thickening agents is preferred to make the grease of this invention. Included among the preferred thickening agents are those containing at least a portion of alkali metal or alkaline earth metal or amine or hydrocarbylamine soaps of hydroxy-containing fatty acids, fatty glycerides and fatty esters having from 12 to about 30 carbon atoms per molecule. The metals are typified by sodium, lithium, calcium and barium. Preferred is lithium. Preferred members among these acids and fatty materials are those derived from 12-hydroxystearic acid and glycerides containing 12-hydroxystearates; 14-hdyroxystearic aid; 16-hydroxystearic acid; and 6-hydroxystearic acid.

The entire amount of thickener need not be derived from the aforementioned preferred members. Significant benefit can be attained using as little thereof as about 15% by weight of the 12-hydroxystearate containing thickener in the total thickener. A complementary amount, i.e., up to about 85% by weight of a wide variety of thickening agents can be used in the grease of this invention. Included among the other useful thickening agents are alkali and alkaline earth metal soaps of methyl-12-hdyroxystearate, diesters of a $C_4$ to $C_{12}$ dicarboxylic acid and tall oil fatty acids. Other alkali or alkaline earth metal fatty acids containing from 12 to 30 carbon atoms and no free hydroxyl may be used. These include soaps of stearic and oleic acids.

Other thickening agents include salt and salt-soap complexes as calcium stearate-actetate (U.S. Pat. No. 2,197,263), barium stearate acetate (U.S. Pat. No. 2,564,561), calcium, stearate-caprylate-acetate complexes (U.S. Pat. No. 2,999,065), calcium caprylate-acetate (U.S. Pat. No. 2,999,066), and calcium salts and soaps of low-, intermediate-and high-molecular weight acids and of nut oil acids. The aforementioned thickening agents can be produced in open kettles, pressurized vessels or continuous manufacturing units. All of these production methods are commonly used for greases and have the necessary supporting equipment to process the grease during and after manufacture of the thickener.

Another group of thickening agents comprises substituted ureas, phthalocyamines, indanthrene, pigments such as perylimides, pyromellitdiimides, and ammeline, as well as certain hydrophobic clays. These thickening agents can be prepared from clays which are initially hydrophilic in character, but which have been converted into a hydrophobic conditon by the introduction of long-chain hydrocarbon radicals into the surface of the clay particles prior to their use as a component of a grease composition, as, for example, by being subjected to a preliminary treatment with an organic cationic surface active agent, such as an onium compound. Typical onium compounds are tetraalkylammonium chlorides, such as dimethyl dioctadecyl ammonium chloride, dimethyl dibenzyl ammonium chloride and mixtures thereof. This method of conversion, being well known to those skilled in the art, is believed to require no further discussion, and does not form a part of the present invention.

The third member(s) that may be present in the grease composition are the phosphorus and sulfur moieties. Both of these can be present in the same molecule, such as in a metal or non-metal phosphorodithioate of the formula

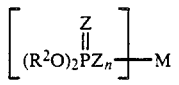

wherein $R^2$ is a hydrocarbyl group containing 3 to 18 carbon atoms, M is a metal or non-metal, n is the valence of M and Z is oxygen or sulfur, at least one being sulfur.

In this compound, $R^2$ is preferably an alkyl group and may be a propyl, butyl, pentyl, hexyl, octyl, decyl, dodecyl, tetradecyl or octadecyl group, including those derived from isopropanol, butanol, isobutanol, sec-butanol, 4-methyl-2-pentanol, 2-ethylhexanol, oleyl alcohol, and mixtures thereof. Further included are alkaryl groups such as butylphenyl, octylphenyl, nonylphenyl and dodecylphenyl groups.

The metals covered by M include those in Groups IA, IB, IIA, IIB, VIB and VIII of the Periodic Table. Some that may be mentioned are lithium, sodium, calcium, barium, zinc, cadmium, silver, molybdenum and gold. Non-metallic ions include organic groups derived from vinyl esters such as vinyl acetate, vinyl ethers such as butyl vinyl ether and epoxides such as propylene oxide and 1,2-epoxydodecane. Non-metallic ions also include organic amine moieties such as hydrocarbylamines, e.g., mono- and diamines. Such amines embrace oleylamine as well as the imidazolines and the oxazolines.

The phosphorus and sulfur can also be supplied from the combination of two separate compounds, such as the combination of (1) a dihydrocarbyl phosphite having 2 to 10 carbon atoms in each hydrocarbyl group or mixtures of phosphites and (2) a sulfide such as sulfurized isobutylene, dibenzyl disulfide, sulfurized terpenes and sulfurized jojoba oil.The phosphites embrace the dibutyl, dihexyl, dioctyl, didecyl and similar phosphites. Phosphate esters containing 4 to 20 carbon atoms in each hydrocarbyl group, such as tributyl phosphate, tridecyl phosphate, tricresyl phosphate and mixtures of such phosphates, can also be used.

In summary, it is essential to the practice of this invention, in which greases having vastly improved dropping points are obtained, that at least the first two of the above-mentioned ingredients be formulated into the composition. Thus:

first, with respect to the preparation of the grease, the total thickener will have at least about 15% by weight of a metal or non-metal hydroxy-containing soap therein, and there will be present from about 3% to about 20% by weight of thickener based on the grease composition; and second, there will be added to the grease from about 0.1% to about 10% by weight, preferably about 0.1% to about 2%, of a borated diol, in which the borated diol has been reacted with preferably at least an equimolar amount of boron; and third component, the composition may have therein from 0.01% to about 10% by weight, preferably from 0.2% to 2% by weight of phosphorus- and sulfur-containing compounds or a mixture of two or more compounds which separately supply the phosphorus and sulfur moieties. If separate compounds are used, an amount of the mixture equivalent to the above concentration levels is used to supply desired amounts of phosphorus and sulfur.

It was noted that, when the hydroxy-containing thickener was used with the borated diol, the dropping point of the grease was consistently unexpectedly higher than with a grease from the same grease vehicle and the same borated diol, but with a different thickener, e.g., a non-hydroxy-containing thickener. Thus, the broad invention is to a grease composition comprising the two components mentioned.

In general, the reaction products of the present invention may be employed in any amount which is effective for imparting the desired degree of friction reduction, antiwear activity, antioxidant activity, high temeprature stability or antirust activity. In many applications, however, the borated diol and the phosphorus- and/or sulfur-containing compound(s) are effectively employed in combined amounts from about 0.02% to about 20% by weight, and preferably from about 0.2% to about 4% of the total weight of the composition.

The greases of the present invention can be made from either a mineral oil or a synthetic oil, or mixtures thereof. In general, mineral oils, both paraffinic, naphthenic and mixtures thereof, may be of any suitable lubricating viscosity range, as for example, from about 45 SSU at 100° F. to about 6000 SSU at 100° F., and preferably from about 50 to about 250 SSU at 210° F. These oils may have viscosity indexes ranging to about 100 or higher. Viscosity indexes from about 70 to about 95 are preferred. The average molecular weights of these oils may range from about 250 to about 800. In making the grease, the lubricating oil from which it is prepared is generally employed in an amount sufficient to balance the total grease composition, after accounting for the desired quantity of the thickening agent, and other additive components to be included in the grease formulation.

In instances where synthetic oils are desired, in preference to mineral oils, various compounds of this type may be successfully utilized. Typical synthetic vehicles include polyisobutylene, polybutenes, hydrogenated polydecenes, polypropylene glycol, polyethylene glycol, trimethylol propane esters, neopentyl and pentaerythritol esters, di(2-ethylhexyl) sebcate, di(2-ethylhexyl adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes), alkyl-substituted diphenyl ethers typified by a butyl-substituted bis(p-phenoxy phenyl) ether, phenoxy phenylethers.

The metallic soap grease compositions containing one or more of the borated diols and, optionally, one or more of the sulfur and phosphorus combinations described herewith provide advantages in increased dropping point, improved grease consistency properties, antirust characteristics and potential antifatigue, antiwear and antioxidant benefits unavailable in any of the prior greases known to us. The grease of this invention is unique in that it can be preferably manufactured by the admixture of additive quantities of the alcohol borates to the fully formed soap grease after completion of saponification.

The following Examples will present illustrations of the invention. They are illustrative only, and are not meant to limit the invention.

EXAMPLE 1

Approximately 1500 g of 1,2-mixed pentadecanedioloctadecanediols (containing approximately 28% 1,2-pentadecanediol, 28% 1,2 hexadecanediol, 28% 1,2-heptadecanediol and 16% 1,2-octadecanediol, 600 g of toluene and 235 g of boric acid where charged to a 5 liter reactor equipped with agitator, heater, Dean-Stark tube with a condensor and provision for blanketing vapor space with nitrogen. The reactor contents were heated up to about 155° C. and kept there until water evolution ceased. The solvent was removed by vacuum topping at 150° C. and the product was filtered through diatomaceous earth at about 120° C.

EXAMPLE 2

A lithium hydroxystearate grease thickener ws prepared by saponification of a mixture containing 12-hydroxystearic acid (8%) and glyceride thereof (9%) with lithium hydroxide in a mineral oil vehicle at about 174° C. in a closed contactor. After depressuring and dehydration of the thickener in an open kettle sufficient mineral oil was added to reduce the thickener content to about 9.0%. After cooling to about 74° C. a typical grease additive package, consisting of an amine antioxidant, phenolic antioxidant, metallic dithiophosphate, sulfur-containing metal deactivator and nitrogen containing antirust additives, was added.

EXAMPLE 3

After dehydrating the thickener in an open kettle, 2.0% by weight of the boron ester of Example 1 was added to the grease concentrate of Example 2. The concentrate was heated at 110° C.–116° C. The grease was then tested in the ASTM D2265-test for dropping point. Results are shown in the following table.

The addition of 2.0 wt. % of borated $C_{15}$ to $C_{18}$ diols to the base grease in a laboratory blend mixed at 110°–116° C. increased the grease dropping point to 305° C. These data are summarized in Table 1.

EXAMPLE 4

Base grease thickened with the lithium soap of a 50/50 (wt) mixture of stearic and palmitic acids, containing only non-hydroxy-containing soap thickeners.

EXAMPLE 5

50 wt. % of the grease used with Example 2 product and 50 wt. % of the grease of Example 4.

EXAMPLE 6

Base grease of Example 4 containing 2 wt. % of the product of Example 1.

TABLE 1

| Sample | D2265 Dropping Point °C. |
|---|---|
| Base grease of Example 2 (containing amine antioxidant, phenolic antioxidant, 1.5% zinc dithiophosphate and sulfur-containing metal deactivator and nitrogen containing antirust additives | 201 |
| Grease of Example 3 | 305 |
| Grease of Example 4 | 209 |
| Grease of Example 5 | 190 |
| Grease of Example 6 | 207 |

The above mentioned zinc dithiophosphate was derived from mixed $C_3$ secondary (isopropyl) and $C_6$ primary alcohols.

We claim:

1. A grease composition comprising a major amount of a grease and from about 0.01% to about 10% by weight of the composition of:

(a) a boronated diol compound consisting essentially of the reaction product made by reacting a diol of the formula $R(OH)_2$ wherein R is a hydrocarbyl group containing from 8 to 30 carbon atoms with a boron compound selected from the group consisting of boric acid, boric oxide, metaborate and an alkyl borate of the formula $(R^1O)_yB(OH)_z$ wherein y is 1 to 3, z is 0 to 2, their sum being 3, and $R^1$ is an alkyl group having 1 to 6 carbon atoms, and (b) a thickener containing at least 15% by weight of a hydroxy-containing soap thickener.

2. The composition of claim 1 additionally containing from about 0.01% to about 10% by weight of the composition of a phosphorus and sulfur compound or a mixture of phosphorus-containing and sulfur-containing compounds to supply an equivalent amount of phosphorus and sulfur.

3. The composition of claim 1 wherein the thickener is an alkali metla, alkaline earth metal or amine soap of a hydroxy-containing fatty acid, fatty glyceride or fatty ester containing 12 to 30 carbon atoms.

4. The composition of claim 3 wherein the metal is sodium, lithium, calcium or barium.

5. The composition of claim 1 wherein R is octyl, decyl, dodecyl, tetradecyl, pentadecyl, octadecyl, eicosyl, triacontyl, 1,2-mixed $C_{15}$ to $C_{18}$ alkyls, or is derived from propylene or butylene oligomers or is a mixture of any of these.

6. The composition of claim 3 wherein the thickener is derived from 12-hydroxystearic acid, 14-hydroxystearic acid or 16-hydroxystearic acid or 6-hydroxystearic acid or the ester or glyceride thereof.

7. The composition of claim 6 wherein the diol is a 1,2-mixed $C_{15}$ to $C_{18}$ diol.

8. The composition of claim 1 wherein the boron compound is boric acid.

9. The composition of claim 2 wherein the phosphorus and sulfur moieties are supplied by a phosphorothioate of the formula $$\left[(R^2O)_2P(=Z)\right]_n M$$

wherein $R^2$ is a hydrocarbyl group containing 3 to 18 carbon atoms, M is a metal or non-metal, n is the valence of M and Z is oxygen or sulfur, at least one of the Z atoms being sulfur.

10. The composition of claim 9 wherein $R^2$ is an alkyl group or an alkaryl group.

11. The composition of claim 9 wherein $R^2$ is a propyl, butyl, pentyl, hexyl, octyl, dodecyl, tetradecyl, octadecyl, oleyl, butylphenyl, octylphenyl, nonylphenyl or dodecylphenyl group or mixtures thereof.

12. The composition of claim 11 wherein $R^2$ is derived from isopropanol, butanol, isobutanol, sec-butanol, 4-methyl-2-pentanol, 2-ethylhexanol or mixtures thereof.

13. The composition of claim 9 wherein M is a metal from Group IA, IB, IIA, IIB, VIB or VIII of the Periodic Table.

14. The composition of claim 13 wherein the metal is lithium, sodium, calcium, zinc, cadmium, molybdenum or gold.

15. The composition of claim 14 wherein the metal is zinc.

16. The composition of claim 14 wherein the metal is molybdenum.

17. The composition of claim 9 wherein M is derived from vinyl acetate, butyl vinyl ether, propylene oxide, 1,2-epoxydodecane or hydrocarbylamine.

18. The composition of claim 1 wherein the phosphorus and sulfur moieties are supplied by a combination of (1) a dihydrocarbyl phosphite having 2 to 10 carbon atoms in each hydrocarbyl group, mixtures of such phosphites, or a dihydrocarbyl phosphate ester having 4 to 20 carbon atoms in each hydrocarbyl group and (2) a sulfide selected from sulfurized isobutylene, dibenzyl disulfide, sulfurized terpenes, phosphorodithionyl disulfide and sulfurized jojoba oil.

19. The composition of claim 18 wherein the phosphite is a dibutyl, dihexyl, dioctyl or didecyl phosphite or mixtures thereof.

20. The composition of claim 18 wherein the phosphate ester is a tributyl, tridecyl or tricresyl phosphate or mixtures thereof.

21. The composition of claim 9 wherein the diol is 1,2-mixed pentadecanediol-octadecanediol, the boron compound is boric acid and the phosphorus- and sulfur-containing compound is zinc dialkyl phosphorodithioate wherein the alkyl group is derived from mixed $C_3$ secondary and $C_6$ primary alcohols.

22. The composition of claim 1 wherein the grease vehicle is a mineral oil.

23. The composition of claim 1 wherein the grease vehicle is a synthetic oil.

24. The composition of claim 1 wherein the grease vehicle is a mixture of mineral and synthetic oils.

25. A method of improving the dropping point of a grease composition comprising a major proportion of a grease and from about 0.01% to about 10% by weight of the composition of a reaction product consisting essentially of the reaction product made by made by reacting a diol of the formula $R(OH)_2$ wherein R is a hydrocarbyl group containing from 8 to 30 carbon atoms with a boron compound, the improvement comprising thickening said grease with a thickener containing at least about 15% by weight of a hydroxy-containing soap thickener.

26. The method of claim 25 in which the grease composition additionally contains from about 0.01% to about 10% by weight of the composition of a phosphorus and sulfur compound or a mixture of phosphorus-containing and sulfur-containing compounds to supply an equivalent amount of phosphorus and sulfur.

27. A method of making a grease composition comprising mixing a major proportion of a grease with (a) about 0.01% to about 10% by weight of the composition of a boronated diol compound consisting essentially of the reaction product made by recting a diol of the formula $R(OH)_2$ wherein R is a hydrocarbyl group containing from 8 to 30 carbon atoms with a boron compound selected from the group consisting of boric acid, boric oxide, metaborate and an alkyl borate of the formula $(R^1O)_yB(OH)_z$ wherein y is 1 to 3, z is 0 to 2, their sum being 3, and $R^1$ is an alkyl group having 1 to 6 carbon atoms, and (b) a thickener containing at least about 15% by weight of a hydroxy-containing soap thickener.

* * * * *